US011186394B2

(12) United States Patent
Ni

(10) Patent No.: US 11,186,394 B2
(45) Date of Patent: Nov. 30, 2021

(54) CABLE TIE TENSIONING AND SEVERING TOOL

(71) Applicant: Hua Wei Industrial Co., Ltd., Taichung (TW)

(72) Inventor: Wei Chieh Ni, Taichung (TW)

(73) Assignee: Hua Wei Industrial Co., Ltd., Taichung (TW)

( * ) Notice: Subject to any disclaimer, the term of this patent is extended or adjusted under 35 U.S.C. 154(b) by 297 days.

(21) Appl. No.: 16/580,772

(22) Filed: Sep. 24, 2019

(65) Prior Publication Data

US 2020/0180799 A1 Jun. 11, 2020

(30) Foreign Application Priority Data

Dec. 11, 2018 (TW) ..... 107216801

(51) Int. Cl.
*B65B 13/02* (2006.01)
*B25B 25/00* (2006.01)
*B26D 7/14* (2006.01)

(52) U.S. Cl.
CPC ..... *B65B 13/027* (2013.01); *B25B 25/00* (2013.01); *B26D 7/14* (2013.01)

(58) Field of Classification Search
CPC ..... B65B 13/025; B65B 13/027; B65B 13/22; B25B 25/00
USPC ..... 100/6, 32
See application file for complete search history.

(56) References Cited

U.S. PATENT DOCUMENTS 4,793,385 A * 12/1988 Dyer ..... B65B 13/027 140/123.6
4,997,011 A * 3/1991 Dyer ..... B65B 13/027 140/123.6
5,492,156 A * 2/1996 Dyer ..... B21F 9/02 140/123.6
6,206,053 B1 * 3/2001 Hillegonds ..... B65B 13/027 140/123.6
9,550,590 B2 1/2017 Dyer
2013/0167698 A1 * 7/2013 Dyer ..... B26D 7/14 83/175
2016/0167813 A1 * 6/2016 Myers ..... B25B 25/00 254/250
2019/0210749 A1 * 7/2019 Kitago ..... B65B 13/027

* cited by examiner

*Primary Examiner* — Gregory D Swiatocha
*Assistant Examiner* — Bobby Yeonjin Kim
(74) *Attorney, Agent, or Firm* — Thomas J. Nikolai; DeWitt LLP

(57) ABSTRACT

A cable tie tensioning and severing tool includes: a cutting member, a pulling member with a pivotable pushing block abutting against the cutting member, a trigger with a stop block abutting against the pushing block, a pivotable pressing hammer, a turning knob, and an elastic member compressed between the pressing hammer and a spirally ramped end face of the turning knob such that the pressing hammer applies to the cutting member a pressing force whose magnitude can be adjusted by rotating the turning knob. The stop block can be driven by the trigger to push the pushing block, which in turn pulls a cable tie through the pulling member and, once the pressing force is overcome, pivots the cutting member to sever the cable tie.

5 Claims, 8 Drawing Sheets

CABLE TIE TENSIONING AND SEVERING TOOL

BACKGROUND OF THE INVENTION

1. Technical Field

The present invention relates to a cable tie severing tool and more particularly to a cable tie severing tool capable of adjusting the tightness of cable ties.

2. Description of Related Art

A cable tie can be used to fasten a plurality of objects together, and once the cable tie is tightened, it is often required to cut off the excess portion of the tie with scissors. In light of this, dedicated cable tie severing tools were developed, such as those disclosed in U.S. Pat. Nos. 9,550,590 B2 and 6,206,053 B1. In addition to performing the basic function of severing cable ties, those severing tools can adjust the tightness with which a plurality of objects are fastened with a cable tie, before the tie is severed. More specifically, such a cable tie severing tool can adjust the distance for which a cable tie is pulled during the entire trigger pressing operation (which starts with the user pulling the trigger and ends when the trigger is fully depressed) in order to meet different user needs.

The patented tools mentioned above, however, are structurally complicated and include a large number of tiny components, which not only incur high material costs but also add to the technical difficulty of product assembly, resulting in high selling prices and hence low market competitiveness. Moreover, the numerous delicate components are easily damaged during use and therefore tend to cause inconvenience to tool users.

BRIEF SUMMARY OF THE INVENTION

The primary objective of the present invention is to provide a cable tie tensioning and severing tool that uses only a small number of simple components to enable the adjustment of cable tie tightness. Compared with the prior art, therefore, the tool disclosed herein features a lower material cost, a lower level of technical difficulty of product assembly, and greater convenience of use due to the fact that less physical effort is required for operating the tool.

To achieve the above objective, the present invention provides a cable tie tensioning and severing tool that includes a housing, a cutting member, a pulling member, a trigger, and an adjustment mechanism. The housing is provided with an inlet at one end and a connection opening at the opposite end, wherein the inlet serves as an entrance for a cable tie. The cutting member is pivotally provided in the housing and has a front end and a rear end defined respectively on two opposite sides of the pivotally connected portion of the cutting member, wherein the front end is provided with a blade for severing the cable tie. The pulling member is slidably provided in a channel in the housing, is provided with a toothed block for pulling the cable tie, and is pivotally provided with a pushing block abutting against the rear end of the cutting member. The trigger is pivotally connected to the housing and is provided with a stop block abutting against the pushing block. The adjustment mechanism includes a pressing hammer pivotally provided in the housing, a turning knob pivotally provided in the connection opening, and an elastic member provided between the pressing hammer and the turning knob. One end of the elastic member presses against a ramped end face of the turning knob, with the height of the ramped end face changing continuously in a spiral direction. The opposite end of the elastic member presses against the pressing hammer such that the pressing hammer applies a pressing force to the cutting member. The position at which the elastic member presses against the ramped end face can be adjusted by rotating the turning knob, and the magnitude of the pressing force depends on the position at which the elastic member presses against the ramped end face. By pivoting the trigger, the stop block is driven to push the pushing block. The pushing block, in turn, pulls the pulling member and thereby pulls the cable tie. Once the pressing force applied to the cutting member is overcome by the pushing block, the pushing block pushes and thereby pivots the cutting member to sever the cable tie.

In one embodiment, the turning knob is provided with an axle, and the ramped end face extends spirally around a center defined by the axle. Moreover, the periphery of the axle is provided with a plurality of positioning grooves, and the housing is provided with an elastic positioning member configured to be elastically engaged in any one of the positioning grooves of the axle and thereby secure the turning knob in position.

In addition, the turning knob is circumferentially provided with a marked surface. The marked surface is provided with marking information corresponding in position to the positioning grooves.

In one embodiment, the housing is provided with a restoring spring pressing against the cutting member so that the cutting member can return to its original position when no longer pushed by the pushing block.

In one embodiment, the pressing hammer is provided with a concavely curved portion, and the rear end of the cutting member is provided with a protruding block configured to abut against and be received in the concavely curved portion.

DETAILED DESCRIPTION OF THE INVENTION

Figure 1:
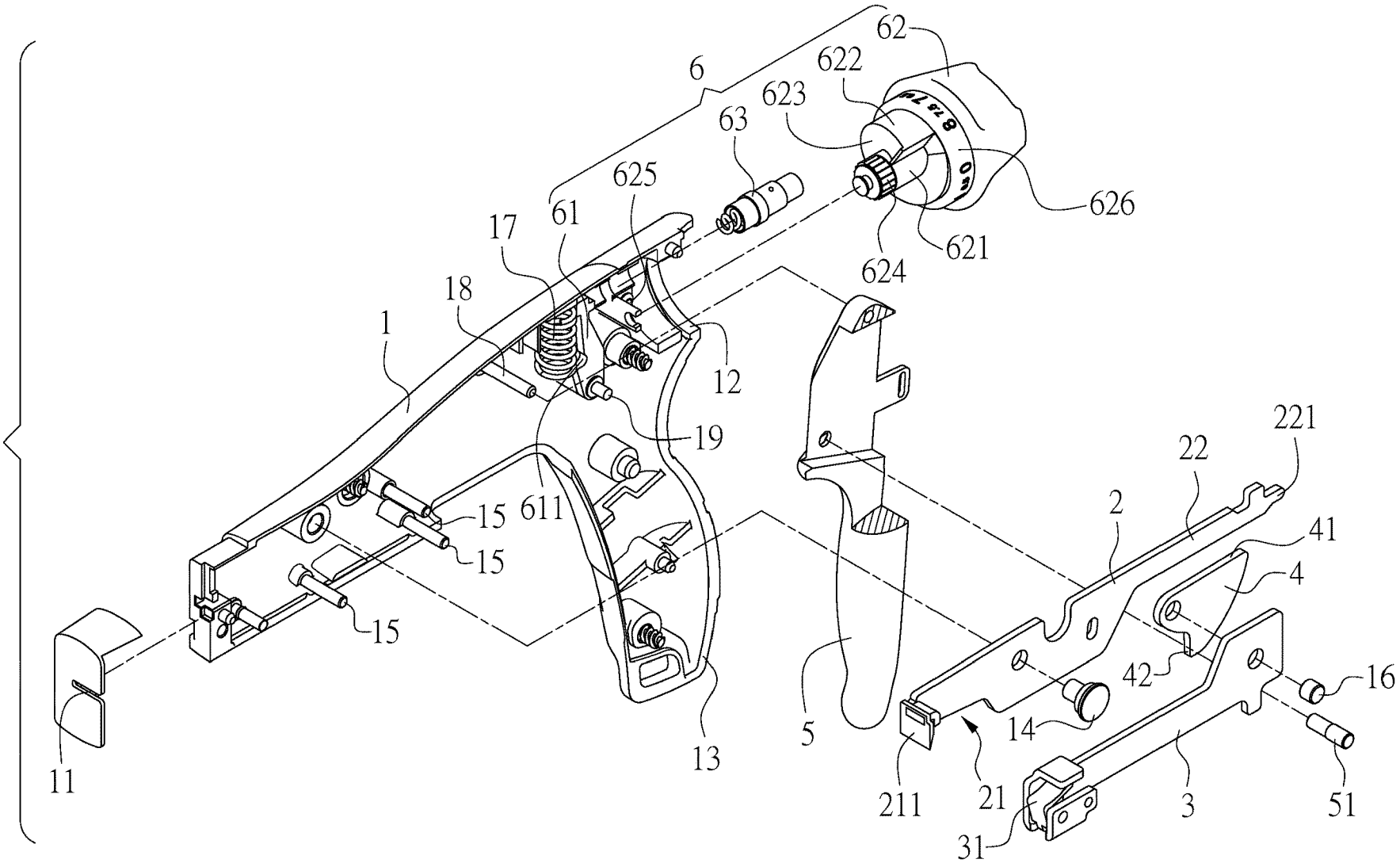
FIG. 1 is an exploded perspective view of an embodiment of the present invention.
Figure 2:
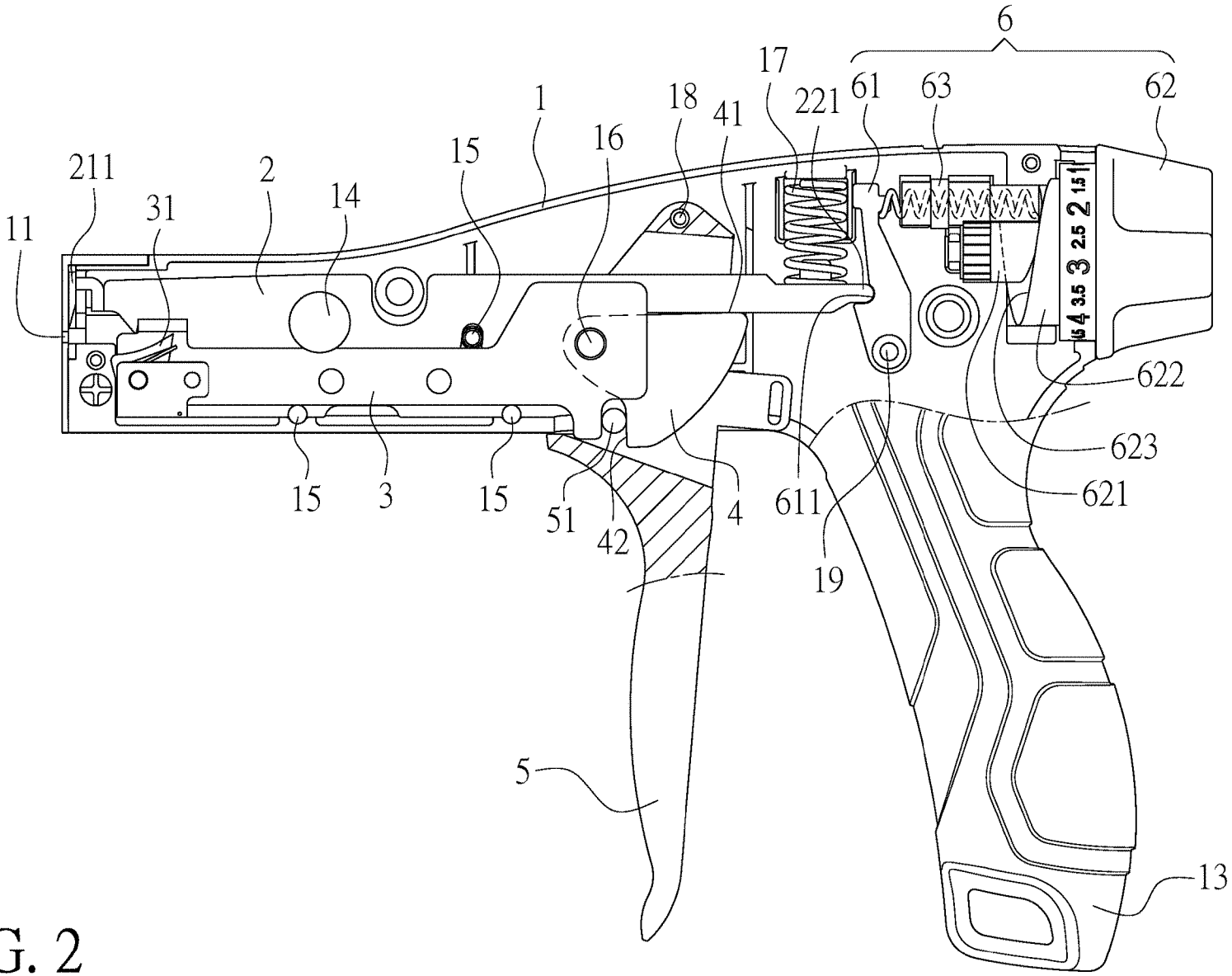
FIG. 2 is a sectional view showing a first state of use of the embodiment in FIG. 1.

Referring to FIG. 1 and FIG. 2, the cable tie tensioning and severing tool according to an embodiment of the present invention includes a gun-shaped housing 1. The front end of the housing 1 is provided with an inlet 11 for use as an entrance for a cable tie. The rear end of the housing 1 is provided with a connection opening 12 and is downwardly extended with a handle 13 to be grasped by the user.

A cutting member 2 is pivotally provided in the housing 1 via a first pivot shaft 14. The cutting member 2 has a front end 21 and a rear end 22 defined respectively on two opposite sides of the first pivot shaft 14. The front end 21 is provided with a blade 211 for severing a cable tie. The rear end 22 is provided with a protruding block 221.

A plurality of position limiting posts 15 are provided in the housing 1 such that a channel is formed between and bounded by the position limiting posts 15. A pulling member 3 is provided in the channel and is configured to slide in the channel. The front end of the pulling member 3 is provided with a toothed block 31 for engaging with and pulling a cable tie. The rear end of the pulling member 3 is pivotally provided with a pushing block 4 via a second pivot shaft 16. The pushing block 4 has an upper abutting surface 41 abutting against the rear end 22 of the cutting member 2.

A trigger 5 is pivotally connected to the housing 1 via a third pivot shaft 18. The trigger 5 lies in front of the handle 13 and can be pivoted toward the handle 13. The trigger 5 is provided with a stop block 51 abutting against a lower abutting surface 42 of the pushing block 4. When the trigger 5 is pulled, the stop block 51 pushes the pushing block 4 rearward such that the pulling member 3 is pulled, i.e., displaced rearward, by the pushing block 4 and therefore pulls the cable tie in the inlet 11. The stop block 51 also pivots the pushing block 4 with respect to the second pivot shaft 16 such that the cutting member 2 is pushed and consequently pivoted by the pushing block 4 and thus drives the blade 211 to severe the cable tie. The housing 1 is further provided with a restoring spring 17 pressing against the cutting member 2 so that the cutting member 2 can return to its original position when no longer pushed by the pushing block 4.

The distance for which a cable tie is pulled (or more particularly the distance for which the end of the cable tie that is engaged with the toothed block 31 of the pulling member 3 is pulled with respect to the objects being fastened with the cable tie) before the cable tie is severed determines the tightness with which the objects are fastened, and in this embodiment, the distance can be adjusted with an adjustment mechanism 6. The adjustment mechanism 6 includes a pressing hammer 61, a turning knob 62, and an elastic member 63. The pressing hammer 61 is pivotally provided in the housing 1 via a fourth pivot shaft 19. The front end of the pressing hammer 61 is provided with a concavely curved portion 611 for abutting against and receiving the protruding block 221 of the cutting member 2. The turning knob 62 is pivotally provided in the connection opening 12 of the housing 1 and can be rotated in the connection opening 12. The turning knob 62 is provided with an axle 621 at the center and a ramped block 622 surrounding the axle 621. The ramped block 622 has a ramped end face 623, whose height changes continuously in a spiral direction.

The elastic member 63 is provided between the pressing hammer 61 and the turning knob 62 and includes a spring and a sleeve mounted around and thereby covering one end of the spring. The elastic member 63 has one end pressing against the ramped end face 623 of the turning knob 62 and the opposite end pressing against the rear side of the pressing hammer 61. Thus, the pressing hammer 61 is pushed by the elastic member 63 and applies a pressing force to the cutting member 2, wherein the pressing force hinders the cutting member 2 from being pivoted by the pushing block 4; in other words, the pushing force applied by the pushing block 4 to the cutting member 2 must be large enough to overcome the pressing force of the pressing hammer 61 in order to pivot the cutting member 2 and thereby drive the blade 211 to sever the cable tie.

The magnitude of the pressing force depends on the position at which the elastic member 63 presses against the ramped end face 623, and this position can be adjusted by rotating the turning knob 62. More specifically, referring to FIG. 2, the turning knob 62 can be so rotated that the elastic member 63 presses against a relatively low position of the ramped end face 623, and that therefore the elastic member 63 is compressed to a relatively small extent and generates a relatively small elastic force, with which the elastic member 63 presses the pressing hammer 61; consequently, the pressing force applied by the pressing hammer 61 to the cutting member 2 is relatively small. Conversely, referring to FIG. 5, the turning knob 62 can be so rotated that the elastic member 63 presses against a relatively high position of the ramped end face 623, and that therefore the elastic member 63 is compressed to a relatively great extent and generates a relatively large elastic force, with which the elastic member 63 presses the pressing hammer 61; as a result, the pressing force applied by the pressing hammer 61 to the cutting member 2 is relatively large.

Figure 3:
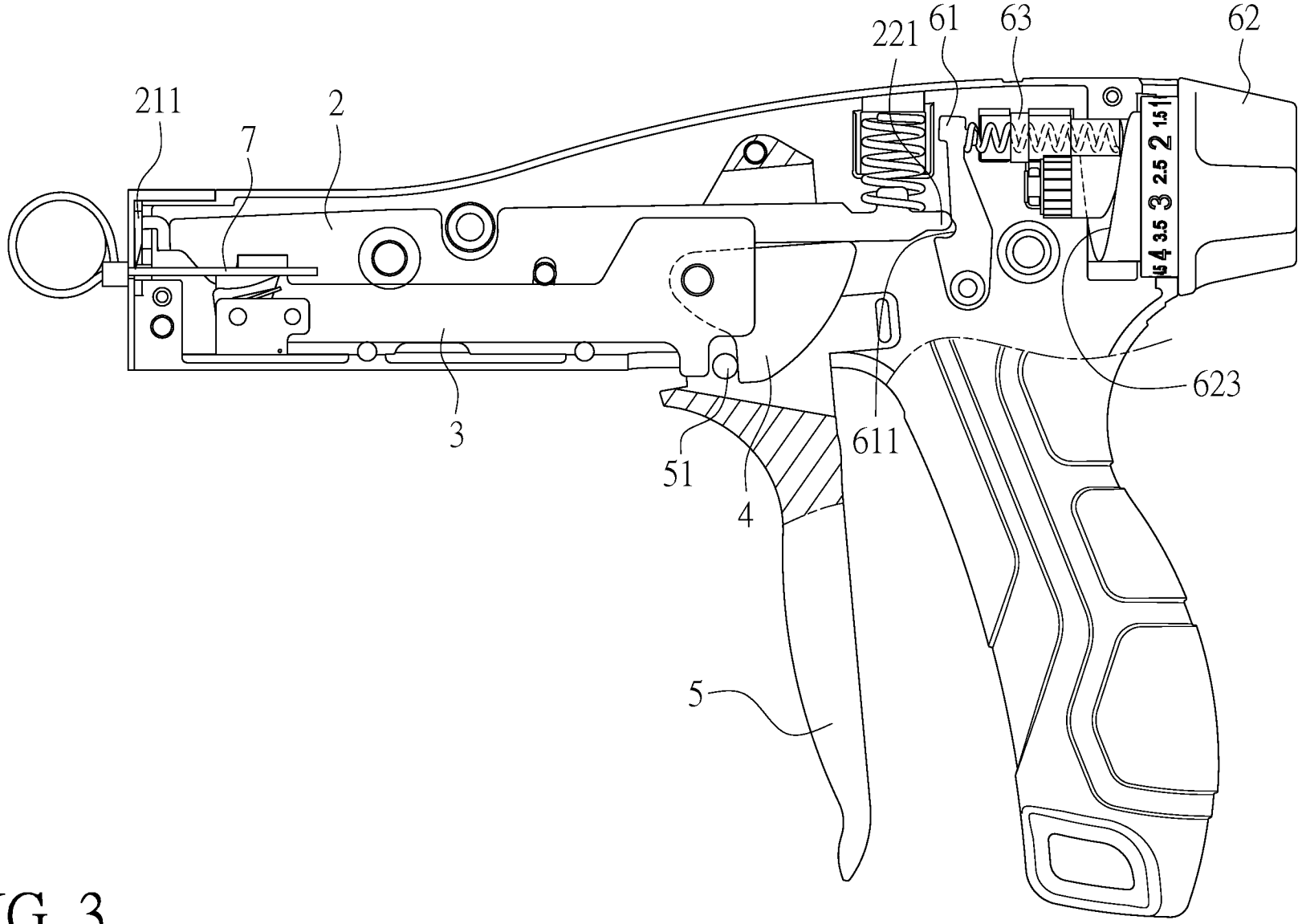
FIG. 3 and FIG. 4 show how the embodiment in FIG. 1 works in the first state of use.
Figure 4:
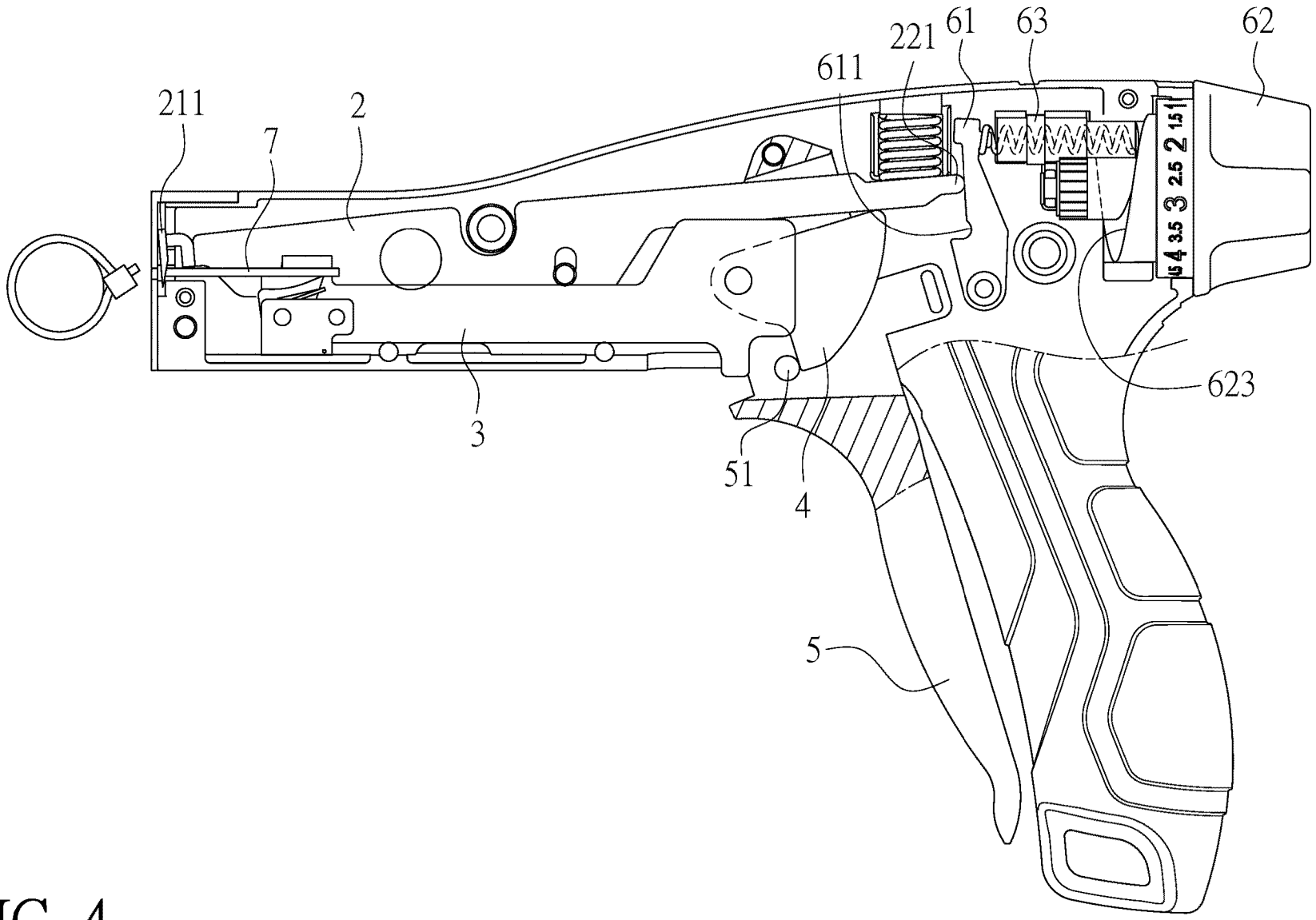

In terms of use, if it is desired that a cable tie is severed without being excessively tensioned (i.e., without the tied objects being fastened too tight) by pulling the trigger 5, the turning knob 62 can be rotated as shown in FIG. 2 so that the elastic member 63 presses against a relatively low position of the ramped end face 623 of the turning knob 62 and hence presses the pressing hammer 61 with a relatively small force, which ends up as a relatively small pressing force applied by the pressing hammer 61 to the cutting member 2. In that case, the trigger 5 only has to be pulled, i.e., pivoted, to a relatively small extent as shown in FIG. 3, and the pushing force applied by the pushing block 4 (which in turn is pushed by the stop block 51) to the cutting member 2 will be large enough to overcome the pressing force applied by the pressing hammer 61 to the cutting member 2, allowing the protruding block 221 of the cutting member 2 to separate from the concavely curved portion 611 of the pressing hammer 61 and pivot, thereby driving the blade 211 to sever the cable tie 7 as shown in FIG. 4.

Figure 5:
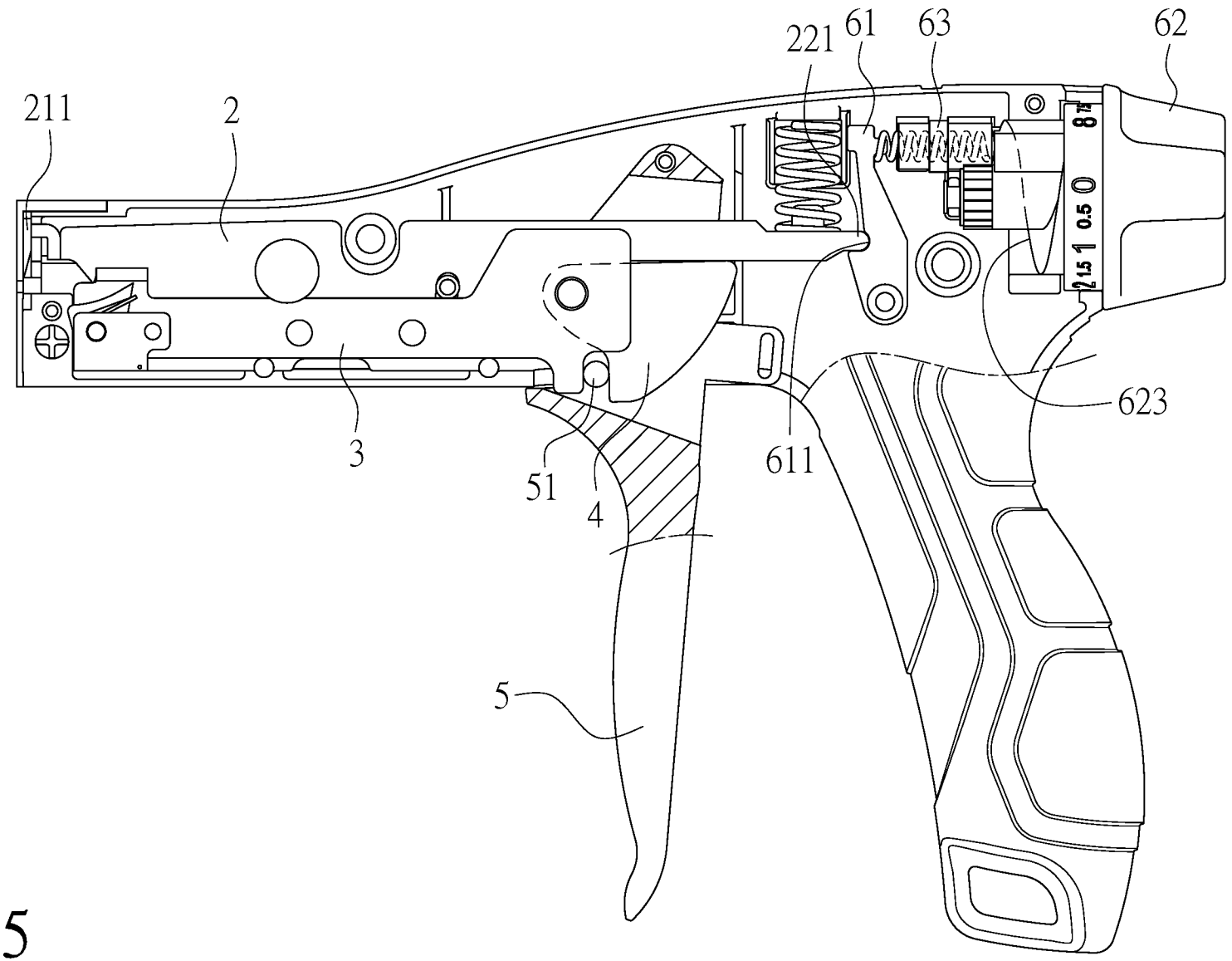
FIG. 5 is a sectional view showing a second state of use of the embodiment in FIG. 1.
Figure 6:
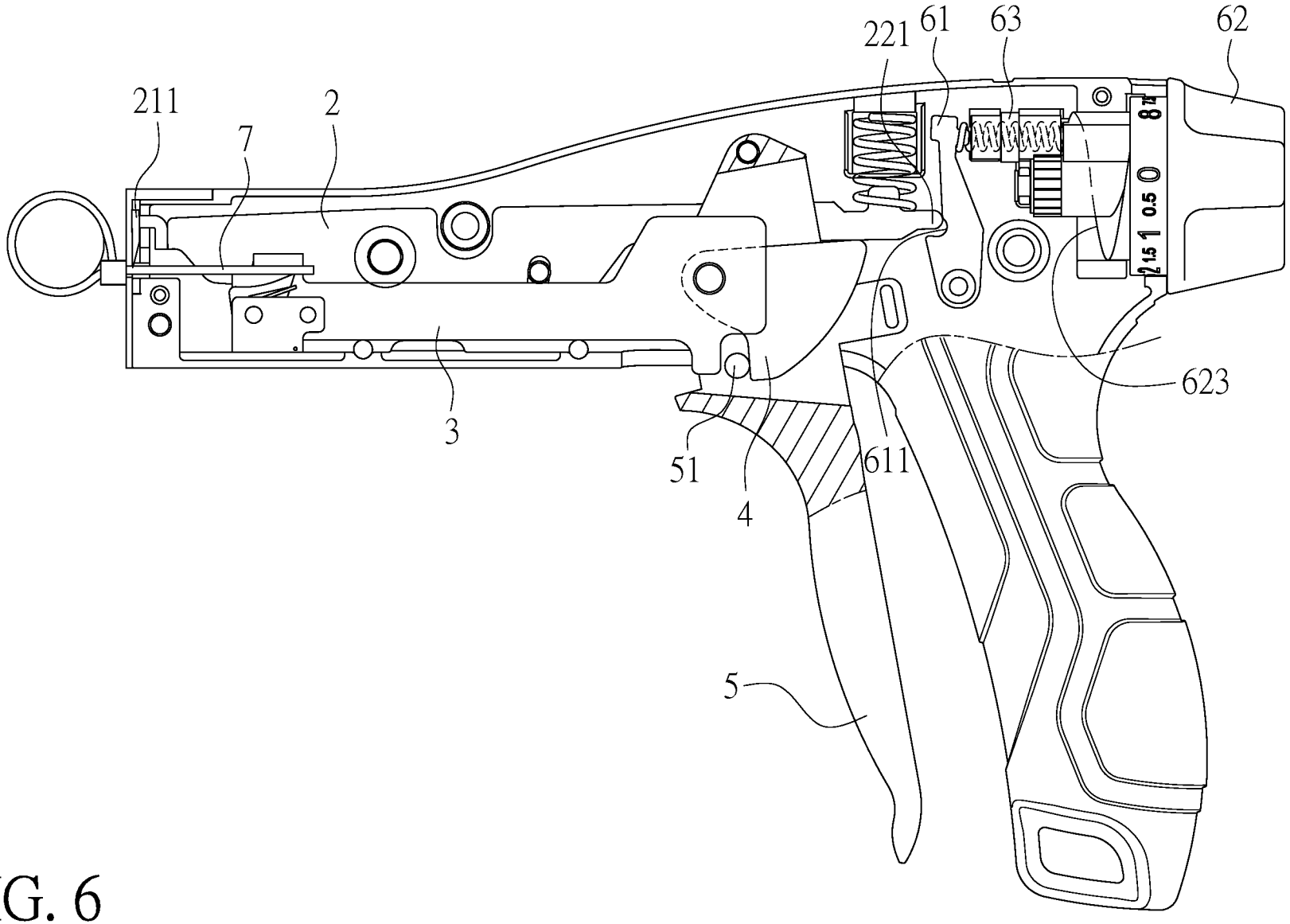
FIG. 6 and FIG. 7 show how the embodiment in FIG. 1 works in the second state of use.
Figure 7:
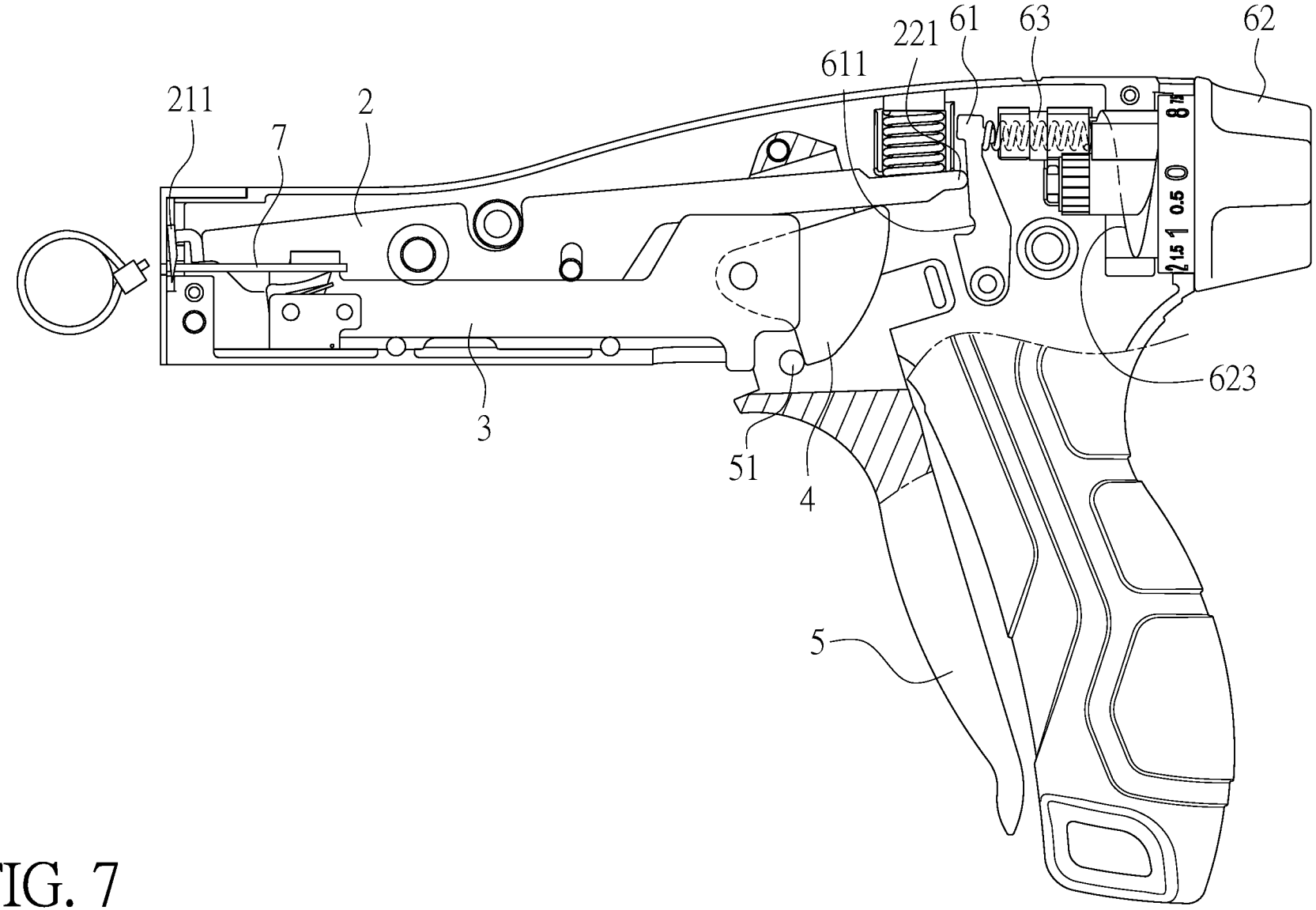

If it is desired that a cable tie is severed under a high tension generated by pulling the trigger 5 (i.e., with the tied objects being tightly fastened), the turning knob 62 can be rotated as shown in FIG. 5 so that the elastic member 63 presses against a relatively high position of the ramped end face 623 of the turning knob 62 and therefore presses the pressing hammer 61 with a relatively large force, which ends up as a relatively large pressing force applied by the pressing hammer 61 to the cutting member 2. In that case, the trigger 5 must be pulled, i.e., pivoted, to a relatively great extent as shown in FIG. 6, in order for the pushing force applied by the pushing block 4 (which in turn is pushed by the stop block 51) to the cutting member 2 to be large enough to overcome the pressing force applied by the pressing hammer 61 to the cutting member 2, and hence for the protruding block 221 of the cutting member 2 to separate from the concavely curved portion 611 of the pressing hammer 61 and pivot, thereby driving the blade 211 to sever the cable tie 7 as shown in FIG. 7.

Figure 8:
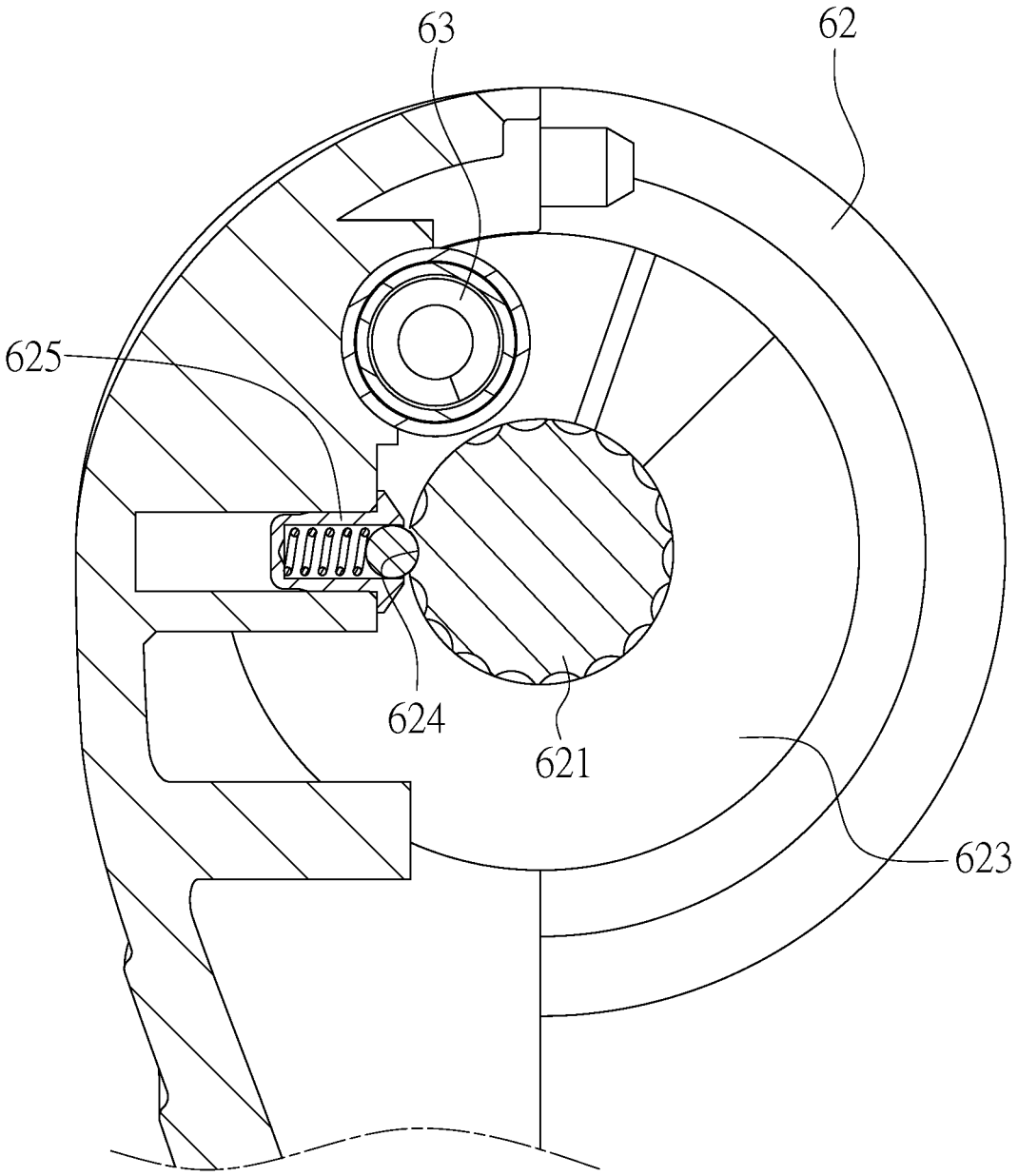
FIG. 8 is a sectional view of the positioning mechanism of the adjustment knob of the embodiment in FIG. 1.

Moreover, referring to FIG. 1 and FIG. 8, the axle 621 of the turning knob 62 is peripherally provided with a plurality of positioning grooves 624, and the housing 1 is provided with an elastic positioning member 625 that includes a spring and a steel ball. The steel ball is pushed by the spring and is thus elastically engaged in the corresponding positioning groove 624 to fix the turning knob 62 in position, allowing the elastic member 63 to press securely against the ramped end face 623. In addition, the turning knob 62 is circumferentially provided with a marked surface 626. The marked surface 626 is provided with marking information corresponding in position to the positioning grooves 624 so that a user can identify the adjusted state of the turning knob 62 simply by viewing the marking information.

The present invention is advantageous in that it allows the tightness of a cable tie to be adjusted using not only a smaller number of components but also simpler components than in the prior art, that it features a lower material cost and a lower level of technical difficulty of assembly than the prior art, and that it provides greater convenience of use than the prior art through an effortless operation enabled by the ramped end face 623 pushing the elastic member 63 while the turning knob 62 is rotated.

What is claimed is:

1. A cable tie tensioning and severing tool, characterized by comprising:

a housing having an end provided with an inlet and an opposite end provided with a connection opening, wherein the inlet is an entrance for a cable tie;

a cutting member pivotally provided in the housing, wherein the cutting member has a front end and a rear end defined respectively on two opposite sides of a pivotally connected portion of the cutting member, and the front end is provided with a blade for severing the cable tie;

a pulling member slidably provided in a channel in the housing, wherein the pulling member is provided with a toothed block for pulling the cable tie and is pivotally provided with a pushing block abutting against the rear end of the cutting member;

a trigger pivotally connected to the housing, wherein the trigger is provided with a stop block abutting against the pushing block; and an adjustment mechanism comprising a pressing hammer pivotally provided in the housing, a turning knob pivotally provided in the connection opening, and an elastic member provided between the pressing hammer and the turning knob, wherein the elastic member has one end pressing against a ramped end face of the turning knob, the ramped end face has a height changing continuously in a spiral direction, the elastic member has an opposite end pressing against the pressing hammer such that the pressing hammer applies a pressing force to the cutting member, the elastic member presses against the ramped end face at a position adjustable by rotating the turning knob, and the magnitude of the pressing force depends on the position at which the elastic member presses against the ramped end face;

wherein by pivoting the trigger, the stop block is driven to push the pushing block such that the pushing block pulls the cable tie through the pulling member and, once the pressing force is overcome, the pushing block pushes and thereby pivots the cutting member to sever the cable tie.

2. The cable tie tensioning and severing tool of claim 1, wherein the turning knob is provided with an axle, the ramped end face extends spirally around a center defined by the axle, the axle is peripherally provided with a plurality of positioning grooves, and the housing is provided with an elastic positioning member configured to be elastically engaged in any one of the positioning grooves of the axle and thereby secure the turning knob in position.

3. The cable tie tensioning and severing tool of claim 2, wherein the turning knob is circumferentially provided with a marked surface, and the marked surface is provided with marking information corresponding in position to the positioning grooves.

4. The cable tie tensioning and severing tool of claim 1, wherein the housing is provided with a restoring spring pressing against the cutting member in order for the cutting member to return to an original position thereof when no longer pushed by the pushing block.

5. The cable tie tensioning and severing tool of claim 1, wherein the pressing hammer is provided with a concavely curved portion, and the rear end of the cutting member is provided with a protruding block configured to abut against and be received in the concavely curved portion.

* * * * *